US007970340B2

(12) United States Patent
Sorita et al.

(10) Patent No.: US 7,970,340 B2
(45) Date of Patent: Jun. 28, 2011

(54) ADHESIVE APPLICATOR, AND BOOKBINDING APPARATUS AND IMAGE-FORMING SYSTEM EQUIPPED WITH THE APPLICATOR

(75) Inventors: Hiroyuki Sorita, Chuo (JP); Katsumasa Takagi, Kofu (JP); Norihiro Ohno, Minamikoma-gun (JP); Jun Kondou, Minami Alps (JP); Kazuyuki Kubota, Minamikoma-gun (JP)

(73) Assignee: Nisca Corporation, Minamikoma-gun (JP)

( * ) Notice: Subject to any disclaimer, the term of this patent is extended or adjusted under 35 U.S.C. 154(b) by 921 days.

(21) Appl. No.: 11/849,884

(22) Filed: Sep. 4, 2007

(65) Prior Publication Data

US 2008/0056735 A1 Mar. 6, 2008

(30) Foreign Application Priority Data

Sep. 4, 2006 (JP) ..... 2006-239577

(51) Int. Cl.
*G03G 15/00* (2006.01)

(52) U.S. Cl. ..... 399/408; 399/407; 412/33; 412/37

(58) Field of Classification Search ..... 399/408, 399/407; 412/33
See application file for complete search history.

(56) References Cited

U.S. PATENT DOCUMENTS 5,140,380 A * 8/1992 Nakamura et al. ..... 399/408
6,508,881 B1 * 1/2003 Muller et al. ..... 118/663
7,448,837 B2 * 11/2008 Oota ..... 412/37

FOREIGN PATENT DOCUMENTS

WO WO 2004060693 A1 * 7/2004

* cited by examiner

*Primary Examiner* — Judy Nguyen
*Assistant Examiner* — Matthew G Marini
(74) *Attorney, Agent, or Firm* — Judge Patent Associates

(57) ABSTRACT

In replenishing a glue container with hot-melt glue, to enable stable supply of the glue in solid form without it clogging the resupply path from the hopper, provided are: a sheet retaining unit for retaining a sheaf in a glue application position; a glue applier in a hot-melt-glue-receiving container, disposed in the glue application position, for applying glue to an endface of a sheaf there; a heater, disposed in the glue container, for heating/melting the glue inside; a heater temperature controller; a resupply hopper above the glue container for replenishing it with solid glue; a vacuum ducting unit above the container and adjoining the resupply hopper, for suctioning up glue evaporation derivatives; and a control unit configured to run the vacuum ducting unit when the glue container is being replenished with glue, to prevent or mitigate invasion of evaporation derivatives into the resupply hopper.

15 Claims, 9 Drawing Sheets

ADHESIVE APPLICATOR, AND BOOKBINDING APPARATUS AND IMAGE-FORMING SYSTEM EQUIPPED WITH THE APPLICATOR

BACKGROUND OF THE INVENTION

1. Technical Field

The present invention—involving adhesive applicators that apply adhesive to a lateral-edge surface of sheet bundles having been collated into sheaves, and then bind the sheaves together with cover sheets or similar coverings—relates to improvements in refilling mechanisms that supply hot-melt adhesive to a glue container, in bookbinding apparatuses or like machines that collate into sheaves sheets on which images have been formed for example in a printing or other image-forming apparatus, and apply hot-melt adhesive to a sheaf and bind it together with a cover sheet.

2. Description of the Related Art

Widely known among adhesive applicators of this type are in general those that with an applicator roll or similar device apply to an endface of a sheet sheaf adhesive in liquid form, charged into a container; the adhesives employed in such implementations are hot-melts—adhesives solid at ordinary temperatures, the solid form of which is heated and melted within a container. Advantages to the adhesives are thus that because they are in solid form at room temperature they are suited to handling and storage, and replenishing apparatus-internal containers with the adhesives is facilitated. On the other hand, included in the adhesives generally used are tackifiers and like additives—the main component of which is synthetic rubber—for increasing the adhesives' viscosity, wherein a known problem with these adhesives is that on account of their being heated to and melted at a predetermined temperature (ordinarily 130° C. to 150° C.), in melting the adhesives additive components evaporate and stick to the apparatus interior. At the same time, the fact that the adhesives solidify at ordinary temperatures requires that hardened adhesive be melted and liquefied in a short time frame at apparatus start-up.

In order to liquefy/melt the adhesive in a shorter time frame, to date, attempts whereby the glue container is scaled down and adhesive is applied by reciprocating the container along the sheet endface have been disclosed—for example in Japanese Unexamined Pat. App. Pub. No. 2004-216769. This publication presents an apparatus in which a glue container with a built-in application roller is disposed free to reciprocate along a guide rail, wherein in reciprocating the container between leftmost and rightmost positions, adhesive is applied with the application roller to an endface of a sheet sheaf. Therein, a structure is disclosed in which a high-frequency heating device disposed at the leftmost position of the reciprocating container melts the adhesive inside the container, and a hopper for resupplying the container with adhesive is disposed in the rightmost position. Furthermore, a vacuum duct is provided in the container leftmost position, opposing the heating device, to provide vacuum filtration of evaporation derivatives generated when the adhesive is heated and melted. With a configuration of this sort an attempt has been made to scale-down the glue container, and at the same time to vacuum-filter constituents from evaporation in melting/liquefying the adhesive, to prevent the constituents from scattering about the apparatus interior.

As described above, in implementations in which a solid adhesive received within a container is heated and melted, and the liquefied adhesive is applied to a sheet sheaf, with additives such as viscosity promoters being included in such types of adhesive, they will include constituents that evaporate into the surrounding atmosphere when the adhesive is heated to a high temperature and melted. The evaporation derivatives have a propensity for splattering onto the apparatus interior or the apparatus exterior and clinging to surrounding objects, and when cooled to ordinary temperatures, solidifying and remaining as clung material.

To address this, as disclosed in above-cited Japanese Unexamined Pat. App. Pub. No. 2004-216769, the evaporation derivatives that issue from the glue container when the adhesive inside the container is heated and melted are vacuum-filtered, yet a problem arising therein is that in replenishing the container with adhesive, the evaporation derivatives cling to adhesive furnished in the hopper or other storage, or cling to the resupply path. The evaporation derivatives that issue from the container melt adhesive furnished within the hopper (adhesive prior to replenishment), or cling to the adhesive and form clots in it, leading to resupply-path clogging problems. Likewise, evaporation derivatives clinging to the resupply path also leads to the problem of the refilling adhesive getting stuck in and clogging the path.

To counter these problems, in the conventional structure in Pat. App. Pub. No. 2004-216769, a heating device is disposed to one (e.g., the leftmost) side of the reciprocating glue container, and the resupply hopper is disposed to the other (rightmost) side, opposing the heating device, but resupplying the container with solid adhesive in a situation in which adhesive therein has been melted at a high temperature leads to the problems just noted. Even supposing that the container is resupplied in a situation in which the adhesive within the container has been cooled to the extent that it will not evaporate, with the structure in this patent publication, the fact that after the container has been refilled with adhesive, it is shifted into the heating-device position on the opposite end of the container's reciprocation path, and there the adhesive is heated and melted, conceals a problem of requiring time until the replenishment adhesive within the container has melted and the apparatus is restarted.

BRIEF SUMMARY OF THE INVENTION

A principal issue for the present invention is to make available an adhesive applicator that when the glue container is replenished with hot-melt adhesive enables stable supply of the adhesive in solid form without it clogging the resupply path from the hopper or other storage, and that makes it possible to shorten the melt time following resupply.

A further issue for the present invention is to make available a bookbinding apparatus and an image-forming system equipped with the apparatus, whereby, in collating sequentially supplied sheets into sheaves, applying adhesive to a sheaf, and binding the sheaf together with a cover sheet or other covering, controlling ramp-up of the adhesive temperature is facilitated and the temperature can be adjusted in a short time, and container adhesive replenishment is made easier.

The present invention employs the following configuration to attain the aforementioned objects. The system is equipped with sheet retaining means that holds a sheet bundle at a predetermined adhesive application position; adhesive application means disposed in the adhesive application position that applies adhesive to a side edge of the sheet bundle; a glue container having the adhesive application means that stores hot-melt adhesive; heating means disposed in the glue container that heats and melts the adhesive in the container; temperature control means that controls the heating means; resupply-hopper means that refills solid adhesive to the glue container; vacuum-ducting means that suctions evaporation derivatives of adhesive from the glue container; and control means that controls the resupply-hopper means and the vacuum-ducting means. The resupply-hopper means and vacuum-ducting means are disposed in positions mutually adjacent above the glue container, and the control means is configured to run the vacuum-ducting means when adhesive is being refilled from the resupply-hopper means to the glue container to prevent or reduce the amount of evaporated adhesive components from entering the refill hopper.

Also, a resupply path is formed between the resupply-hopper means and the glue container to guide solid adhesive. This resupply path is configured to branch from the vacuuming path of the evaporation derivatives provided on the vacuum-ducting means. Furthermore, the control means is configured to stop the heating means while the adhesive is being refilled from the resupply-hopper means to the glue container.

Alternatively, a resupply path is formed between the resupply-hopper means and the glue container to guide solid adhesive, and an opening/shutting shutter plate is furnished in the resupply path.

The glue container is equipped to move along an adhesive application surface of the sheet bundle. The glue container is equipped with shift means that reciprocates the glue container between an idle position and a return position along the adhesive application surface of the sheet bundle. The shift means reciprocates the glue container in order between the idle position, the return position and a resupply position; the vacuum-ducting means and resupply-hopper means are disposed in the resupply position.

Furthermore, the control means is configured to activate the heating means at the resupply position to melt the adhesive after the adhesive is refilled from the resupply-hopper means to the glue container. The glue container is separated into a liquid-matrix receiving compartment and a solid-matrix receiving compartment. The adhesive application means comprises an applicator roll. This applicator roll is rotatably disposed in the liquid-matrix receiving compartment. Also, the vacuum-ducting means is equipped so that its inlet opening of the vacuuming path faces the liquid-matrix receiving compartment. The resupply-hopper means is equipped to face the solid-matrix receiving compartment.

The present invention equips resupply-hopper means that refill adhesive, and vacuum-ducting means that suctions evaporation derivatives from the glue container mutually adjacent above the glue container that applies adhesive to a sheet bundle, to prevent or reduce the amount of evaporation derivatives from entering the refill hopper by activating the vacuum-ducting means when refilling adhesive from the resupply-hopper means. Therefore, evaporation derivatives of adhesive melted in the container do not enter the refill hopper. Furthermore, the high temperature evaporation derivatives do not adhere to or coagulate around when melting solid adhesive prepared in the refill hopper. This makes it possible to smoothly supply a predetermined amount of solid adhesive to the glue container.

Also, the glue container is compact and reciprocates along a side edge of the sheet bundle so the adhesive remaining in the container can be heated to a predetermined temperature at a comparatively short amount of time when starting up the apparatus, and this makes it possible to smoothly refill adhesive to the glue container.

Finally, by installing heating means in the glue container to quickly raise the temperature of the adhesive to melt it at the resupply position, it is possible to melt the adhesive in the glue container to a state for application to the sheet bundle in a short amount of time.

DETAILED DESCRIPTION OF THE INVENTION

Figure 1:
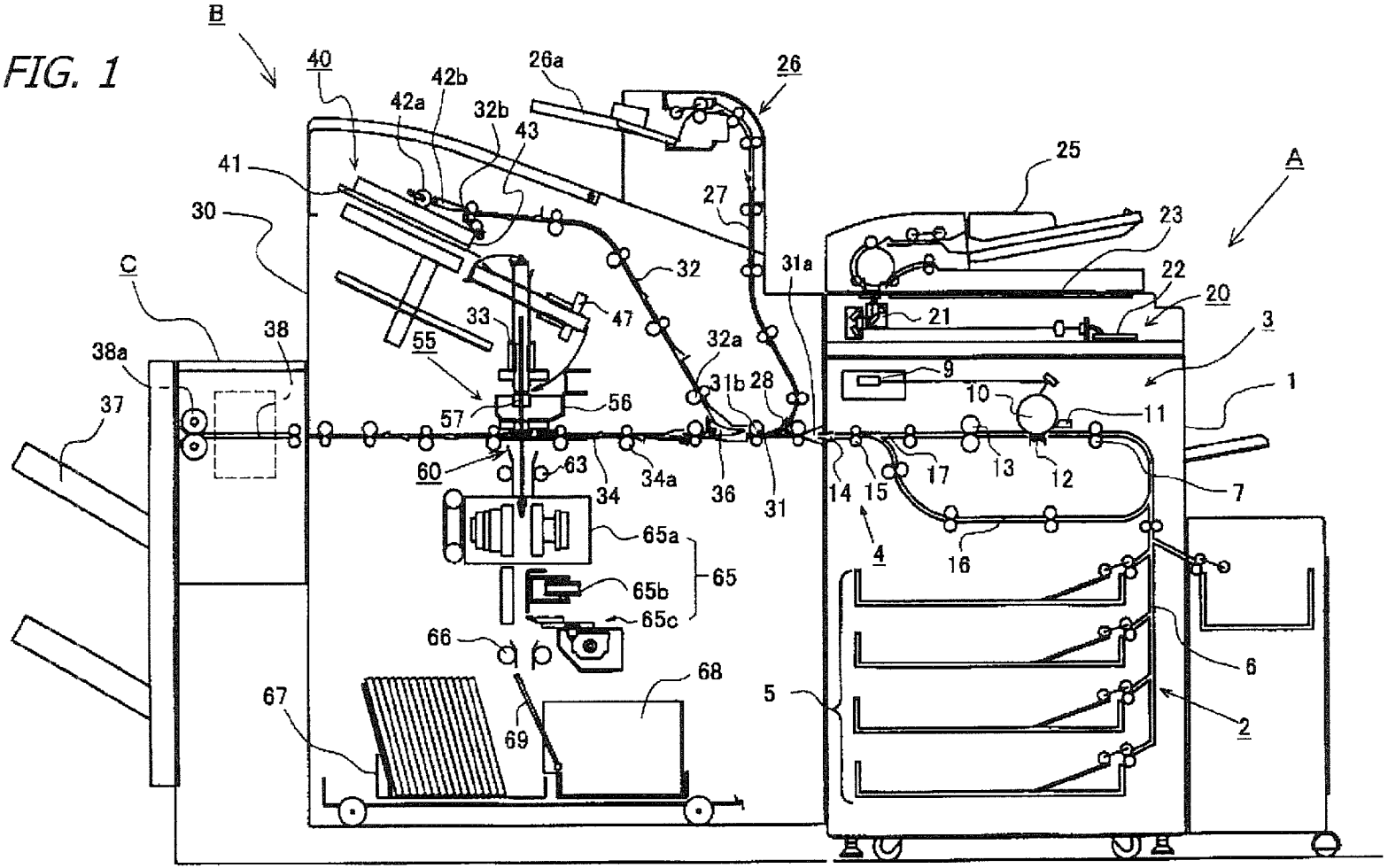
FIG. 1 is an explanatory view of an overall configuration of an image-forming apparatus equipped with a bookbinding apparatus installed with an adhesive applicator according the present invention.
Figure 2:
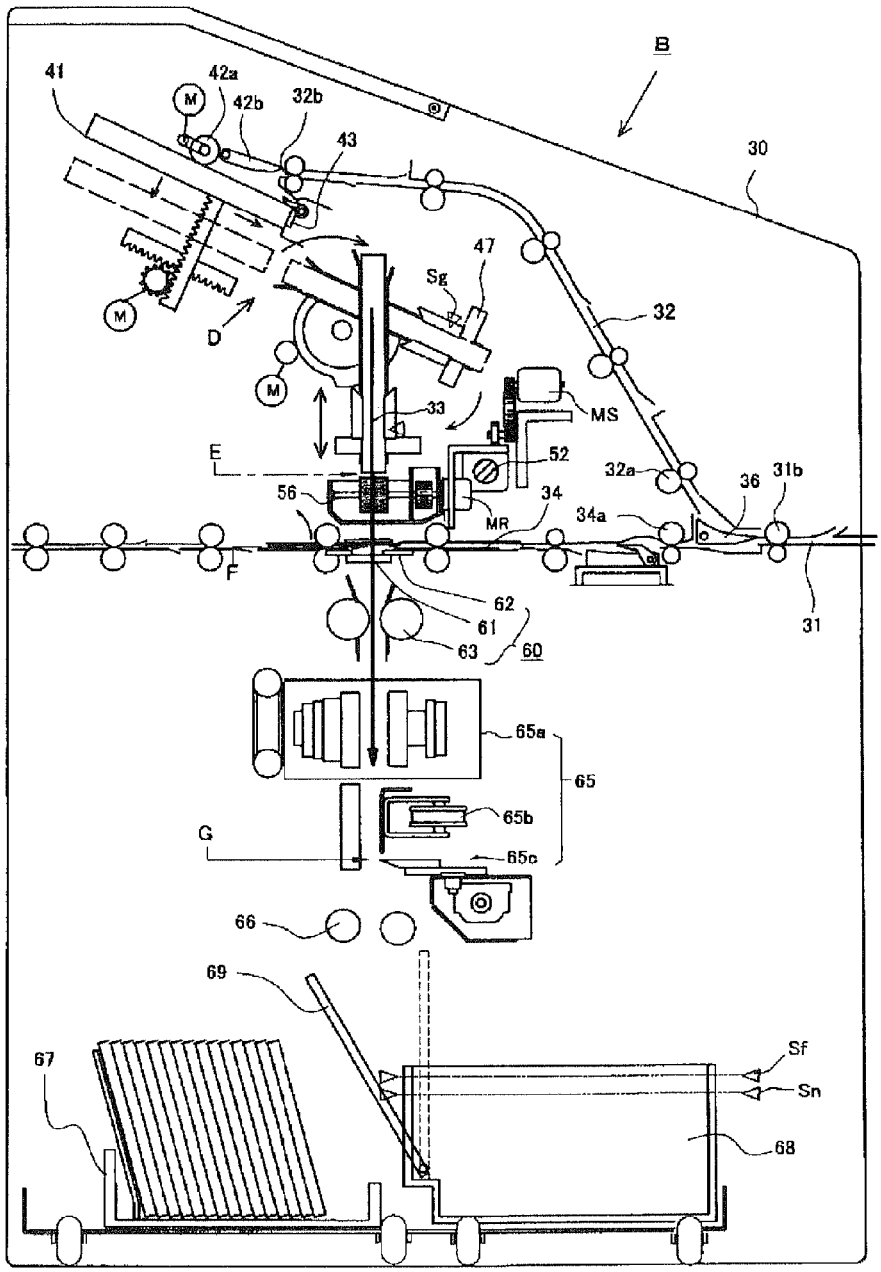
FIG. 2 is a detailed explanatory view of the bookbinding apparatus in the apparatus shown in FIG. 1.

A preferred embodiment of the present invention will now be explained based on the drawings provided. FIG. 1 is an explanatory view of the bookbinding apparatus according to the present invention and the overall configuration of the image-forming system that uses the bookbinding apparatus; FIG. 2 is a detailed explanatory view of the bookbinding apparatus.

The image-forming system shown in FIG. 1 is composed of an image-forming apparatus A that sequentially prints sheets; a bookbinding apparatus B installed at a downstream side adjacent to the image-forming apparatus A; and a finisher C disposed downstream of the bookbinding apparatus B. Sheets formed with images by the image-forming apparatus A are bound into a booklet at the bookbinding apparatus B. The configuration allows sheets not requiring the bookbinding process to pass through the bookbinding apparatus B to undergo a finishing process at the finisher C.

The image-forming apparatus A can implement a variety of structures including a copier, a printer or a printing machine; the drawings show a static-electric printing system. A sheet feeder 2, a printing unit 3, a discharge unit 4 and a control unit are installed inside the casing 1 on the image-forming apparatus A. A plurality of cassettes 4 that support various sheet sizes is provided in the sheet feeder 2. A sheet of the size instructed from the control unit is kicked out to the sheet feeding path 6. Registration rollers 7 are disposed in the sheet feeding path 6. At a predetermined timing after a leading edge of the sheet is aligned at the registration rollers 7, the sheet is fed to the downstream printing unit 3.

A static-electric drum 10 is provided in the printing unit 3, and a print head 9, developer unit 11, and transfer charger 12 are disposed around the static-electric drum 10. The print head 9 is composed of a laser emitter, for example. A latent image is formed on the static-electric drum 10; the developer 11 causes the toner ink to adhere to the latent image; the image is printed onto the sheet by the transfer charger 12. The image is fixed to the printed sheet by a fuser 13, and the sheet is then conveyed out to a discharge path 17. A discharge outlet 14 formed in the casing 1 and a discharge roller 15 are disposed in the discharge unit 4. Note that 16 is a cycling path. Printed sheets from the discharge path 17 are turned over from front to back at a switchback path, then fed again to the registration rollers 7 so that images can be formed on the backside of the printed sheet. In this way, sheets printed with images on the front side or on both sides can be discharged from the discharge outlet 14 by the discharge roller 15.

Note that the symbol 20 in the drawings represents a scanner unit. This optically reads images on an original to be printed by print head 9. The structure is widely known to be composed of a platen 23 where an original sheet is placed; a scanning carriage 21 that travels along the platen 23 to scan the original image; and an optical reading means (such as a CCD device) that photo-electrically converts the optical image from the carriage 21. The drawing shows a document feeder 25 that automatically feeds original sheets is installed above the platen 23.

The following will now explain the bookbinding apparatus B that is attached to the image-forming apparatus A described above. The bookbinding apparatus B is composed of a stacking unit 40 (hereinafter referred to as the stacking tray 41) that stacks sheets in a bundle and aligns their edges in the casing 30; an adhesive application means 55 that applies adhesive to the sheet bundle conveyed from the stacking tray 41; and cover sheet binding means 60 that binds a cover sheet to a sheet bundle that has been applied with adhesive. A sheet conveyance in path 32 (hereinafter referred to as an inner-sheet conveyance path) is disposed at an upstream side of the stacking tray 41, and a bookbinding path 33 is disposed at a downstream side thereof. The stacking unit 40 is composed of the stacking tray 41 disposed in a substantially horizontal direction and stacks and stores printed sheets from a discharge outlet 32*b* of the inner-sheet conveyance path 32.

A forward and reverse rotating roller 42*a* and convey-in guide 42*b* are disposed above the stacking tray 41. The convey-in guide 42*b* guides the printed sheet from the discharge outlet 32*b* to above the stacking tray 41, and the forward and reverse rotating roller 42*a* stores the printed sheet. The forward and reverse rotating roller 42*a* stores the printed sheet in the stacking tray 41 with a forward rotation. When rotated in reverse, the trailing edge of the sheet is pushed against an aligning member 43 disposed at the trailing edge of the tray (the right edge of FIG. 1) to become aligned. An aligning means, not shown, is provided on the stacking tray 41 to align both edges of the printed sheet stored in the tray to reference positions. With this configuration, printed sheets conveyed from the inner-sheet conveyance path 32 are sequentially stacked in the stacking tray 41 and aligned into a bundle shape.

Explanation of Conveyance Paths

The following will explain each sheet conveyance path. In the casing 30, a conveyance in path 31 having a conveyance in inlet 31*a* connected to the discharge outlet 14 of the image-forming apparatus A, and a cover sheet conveyance path 34 connected to the conveyance in path 31 are disposed to intersect the apparatus. A first sheet conveyance path is composed to convey a sheet in a substantially horizontal direct by intersecting the apparatus with the conveyance in path 31 and the cover sheet conveyance path 34. Also, the inner-sheet conveyance path 32 that guides a sheet to the stacking unit 40 (stacking tray 41) is connected to the conveyance in path 31 interposed by a path switching flapper 36 to convey a sheet from the conveyance in inlet 31*a* to the stacking tray 41.

A bookbinding path 33 that longitudinally intersects the apparatus at a downstream side to convey the sheet bundle in a substantially longitudinal direction is provided on the stacking tray 41. A second sheet conveyance path (hereinafter referred to as a bookbinding path) and the first sheet conveyance path (hereinafter referred to as a cover sheet conveyance path) that compose the bookbinding path 33 mutually intersect. The cover sheet binding means 60, described below, is disposed in the intersection. The conveyance in path 31 configured as described above is connected to the discharge outlet 14 of the image-forming apparatus A described above, to receive printed sheets from the image-forming apparatus A. Printed sheets printed (the inner sheets) with information and a sheet (hereinafter referred to as a cover sheet) printed with a title for use as the cover sheet are conveyed out from the image-forming apparatus A. The conveyance in path 31 is separated into the inner-sheet conveyance path 32 and the cover sheet conveyance path 34; these are interposed by a path switching flapper 36. This selects the path to convey each printed sheet.

On the other hand, an inserter device 26 is connected to the conveyance in path 31. This is configured to separate one cover sheet that will not be printed at the image-forming apparatus A at a time from feeder tray 26*a* and feed it to the conveyance in path 31. The inserter device 26 is equipped with one or a plurality of a feeder tray 26*a*. Feeding means that separates stacked sheets into single sheets, and sheet feeding path 27 downstream of the feeding means are disposed on the leading edge of the tray. The sheet feeding path 27 is connected to the conveyance in path 31 interposed by a path switching piece 28. The actions of the path switching piece 28 are described below. The conveyance roller 31*b* is disposed in the convey-in path 31; the conveyance roller 32*a* is disposed in the inner-sheet conveyance path 32; the gripping conveyance means 47 (hereinafter referred to as the sheet bundle gripping means), the turntable unit 65*a*, described below, and the conveyance roller 66 are disposed in the bookbinding path 33. A conveyance roller 34*a* is disposed in the cover sheet conveyance path 34 and a conveyance roller 38*a* is disposed in a finishing path 38; these are connected to a drive motor.

The stacking tray 41 is connected to the inner-sheet conveyance path 32 and the bookbinding path 33 is equipped at a downstream side of the stacking tray 41. The bookbinding process is performed in the bookbinding path 33 while inner sheets stacked in a bundle (hereinafter referred to as a sheet bundle) are sequentially fed. The bookbinding path 33 shown in the drawings is arranged in a substantially longitudinal direction. This is arranged downstream in the order of a sheet bundle posture deviation position D; an adhesive application predetermined position E; a cover sheet binding position F; and a cutting process position G. The cover sheet conveyance path 34 is arranged to intersect the cover sheet binding position F. A cover sheet is fed to the cover sheet binding position F.

An adhesive application means 55 is disposed in the adhesive application position E in the bookbinding path 33. The adhesive application means 55 is composed of a glue container 56 to store hot-melt adhesive; an applicator roll 57; and a roller rotating motor MR. The applicator roll 57 and roller rotating motor MR are incorporated into the glue container 56. The glue container 56 is supported to move along the sheet bundle. By the glue container 56 reciprocating movement to the front to back sides of FIG. 1 along the length direction of the sheet bundle, adhesive is applied to an edge of the sheet bundle.

The configuration of the glue container 56 will now be explained with reference to FIG. 3A. The glue container 56 is separated into a liquefied adhesive storage compartment (hereinafter referred to as a liquid-matrix receiving compartment) 56*a* and a solid-matrix receiving compartment (hereinafter referred to as a solid-matrix receiving compartment) 56*b*; an applicator roll 57 is rotatably disposed in the liquid-matrix receiving compartment 56*a*; a roller rotating motor MR is connected to the applicator roll 57. An adhesive sensor 56*c* that detects the remaining amount of adhesive is disposed in the liquid-matrix receiving compartment 56*a*. The adhesive sensor 56*c* also duals as an adhesive temperature sensor. At the same time that this sensor detects the temperature of the liquefied adhesive in the liquid-matrix receiving compartment 56*a*, it also detects the amount of adhesive remaining in the container according to the difference in temperature of the portion dipped in the adhesive. Also, heating elements (heating means) 50, such as an electric heater or the like, are embedded in the glue container 56. The adhesive sensor 56*c* and heating means 50 are connected to a control CPU 75, and have a temperature control means 79 (shown in FIG. 6) that adjusts the temperature of the adhesive in the liquid-matrix receiving compartment 56*a* to a predetermined melting temperature, and at the same time detect the amount of adhesive that remains.

The solid-matrix receiving compartment 56*b* communicates to the liquid-matrix receiving compartment 56*a*, so adhesive that has melted and become liquefied in the storage container 56*b* flows to the liquid-matrix receiving compartment 56*a*. Also, a stirring rotating body 56*d* is installed in the solid-matrix receiving compartment 56*b*.

The gripping conveyance means 47 that move the sheet from the stacking tray 41 to the adhesive application position E is disposed in the bookbinding path 33. The gripping conveyance means 47 turns the sheet bundle stacked on the stacking tray 41 from a horizontal posture to a vertical posture, then conveys the sheet bundle to the adhesive application position E by conveying it along the bookbinding path 33 disposed in a substantially vertical direction. For that reason, the stacking tray 41 moves from a stacking position (solid lines in FIG. 2) to the hand-over position (dashed line in FIG. 2), and hands over the sheet bundle to the gripping conveyance means 47 prepared at this hand-over position.

The cover sheet binding means 60 is disposed in the cover sheet binding position F of the bookbinding path 33. The cover sheet conveyance path 34 is disposed to intersect the cover sheet binding position F. A cover sheet is fed from the cover sheet conveyance path 34. At the cover sheet binding position F, the cover sheet and the sheet bundle fed from the adhesive application position E are joined together to form a booklet. For that reason, a back-support plate 61 that supports the cover sheet; a folding plates 62 that press forms the joint (backside) of the cover sheet and sheet bundle; and folding rollers 63 are provided in the cover sheet binding position F. A cover sheet binding means 60 is composed of a back-support plate 61, a folding plates 62, and folding rollers 63.

Cutting means 65 is disposed in the cutting process position G positioned downstream of the folding rollers 63. The cutting means 65 is composed of a turntable unit 65*a* that turns the sheet bundle upside down; a cutting edge press unit 65*b* that pressingly supports the edges of the sheet bundle to be cut; and the cutting blade unit 65*c*. The turntable unit 65*a* is configured to revolve while nipping the sheet bundle fed from the folding rollers 63, and to set the sheet bundle at the cutting process position G at the same time. The cutting edge press unit 65*b* is equipped with a pressing member movable in an orthogonal direction to the bookbinding path 33 to pressingly support the edges of the sheet bundle to be cut. The cutting blade unit 65*c* configured to pressingly hold the sheet bundle is composed of a flat-edged shape cutting blade, a blade bearing member that opposes the cutting blade sandwiching the sheet bundle, and the cutter motor that drives the cutting blade.

The cutting means 65 cuts a predetermined amount around the edges, excluding the spine of the sheet bundle that has been made into a booklet, to align the edges. A discharge roller 66 and storage stacker 67 are disposed downstream of the cutting process position G. This storage stacker 67 stores sheet bundles in an inverted manner as shown in the drawing. A full detection sensor Sf is disposed in the storage stacker 67. This detects when the storage stacker 67 is full of stacked sheet bundles, and issues a notice to the operator to remove the sheet bundles.

A cuttings collection box 68 is disposed parallel to the storage stacker 67 below the cutting process position G to store paper cuttings generated by the cutting blade. For that reason, a stopper means 69 is equipped directly below the cutting process position G. The stopper means 69 slides to the left and right of FIG. 2 by a drive motor, not shown. When the sheet bundle is being cut, this is positioned directly below the cutting process position G to guide paper cuttings into the cuttings collection box 68, and after the cutting of the sheet bundle is completed, this retracts from the cutting process position G to enable the sheet bundle to be stored in the storage stacker 67. A full detection sensor Sf and near-full sensor Sn are disposed inside the cuttings collection box 68 to detect the amount of paper cuttings that have been stored. So that the box does not become full while cutting the sheet bundle, for example this near-full sensor Sn is disposed to detect a state where it is possible to store the equivalent of one time to cut the edges of the sheet bundle.

The finisher C is arranged in the bookbinding apparatus B. The finishing path 38 is equipped to be connected to cover sheet conveyance path 34 (first sheet conveyance path) for the finisher C and a finisher, such as a staple unit, punch unit, and stamp unit or the like, is disposed in the finishing path 38. This receives printed sheets from the image-forming apparatus A via the cover sheet conveyance path 34 and staples them together, punches them holes or applies them a marking, then the finisher conveys the finished sheets out to the discharge tray 37. It is also possible to not apply any finishing process on printed sheets and to store them in the discharge tray 37 directly from the image-forming apparatus A.

Adhesive Application Means

The adhesive application means 55 is composed of the glue container 56; an applicator roll 57 rotatably installed in the container; a drive motor MR that rotatingly drives the applicator roll 57; and a drive motor MS that reciprocates the glue container 56 along the sheet bundle. FIGS. 3A and 3B are conceptual views. The glue container 56 is formed to be shorter (in dimension) than the bottom side edge of the sheet bundle (the spine covered at the binding process) S1. This glue container 56 is supported on a guide rail 52 (see FIGS. 3A and 3B) of the apparatus frame to be able to move along the bottom side edge S1 of the sheet bundle S1 along with the applicator roll 57 installed in that container. The glue container 56 is connected to a timing belt 53 installed on the apparatus frame; a drive motor MS is connected to the timing belt 53.

The glue container 56 is shown in the drawings to be configured to move along the sheet bundle, but it is also acceptable to configured to a tray shape that is longer than the length of the sheet bundle, and to move only the applicator roll 57 in the left and right directions of the drawing. Note that the applicator roll 57 shown in the drawing is composed of a porous and heat resistant material and is configured to be impregnated with adhesive and enable adhesive to form layer on the circumference of the applicator roll.

The drive motor MS reciprocates the glue container 56 between a home position HP and a return position RP where the return operation is started along the sheet bundle, and to a refilling position where adhesive can be charged to the container. Each position is set to have the relationships shown in FIGS. 3A and 3B; the return position RP is set based on sheet width size information. Shown in FIG. 3A, a home position HP is set for the glue container 56 that reciprocatingly moves along the sheet bundle at a right limit position in the drawing and a return position Rp is set at an opposite side sandwiching the sheet bundle. A refilling position Ep is set at a left limit position separated from the return position Rp. The glue container 50 is set to the home position HP when the power is turned on (at device initialization). For example, this moves from the home position HP to the return position RP after a predetermined amount of time after a sheet grip signal from the grip sensor Sg of the gripping conveyance means 47. At the same time as this movement, the roller rotating motor MR starts rotating the applicator roll 57. Note that the home position sensor of the glue container 56 is given the symbol SP in the drawing.

Shown in FIG. 3B, a home position HP is set for the glue container 56 that reciprocates along the sheet bundle at a left limit position in the drawing and a return position Rp is set at an opposite side sandwiching the sheet bundle. The home position is set to be the refilling position Ep.

Figure 3A:
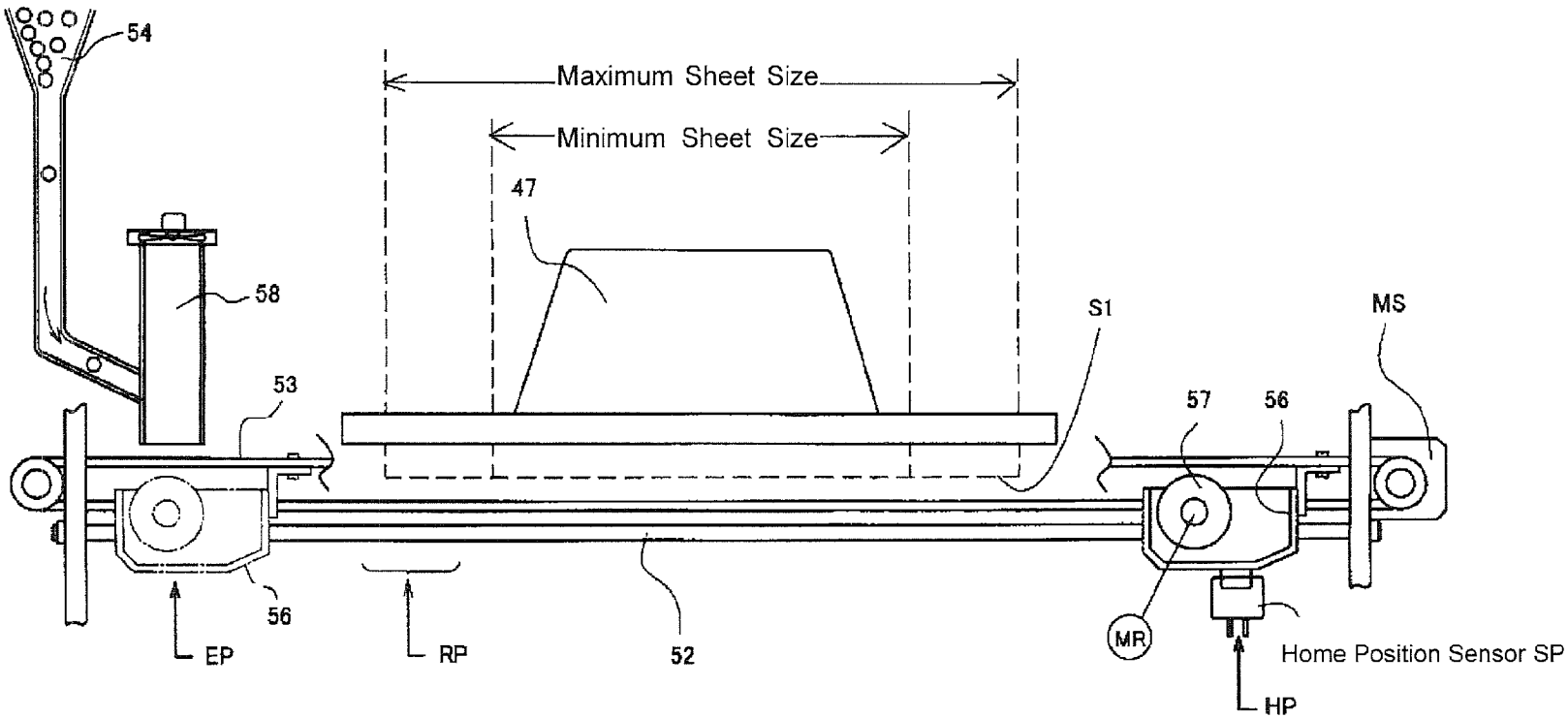
FIG. 3A is an explanatory view of a layout of the adhesive applicator in the apparatus shown in FIG. 2.
Figure 3B:
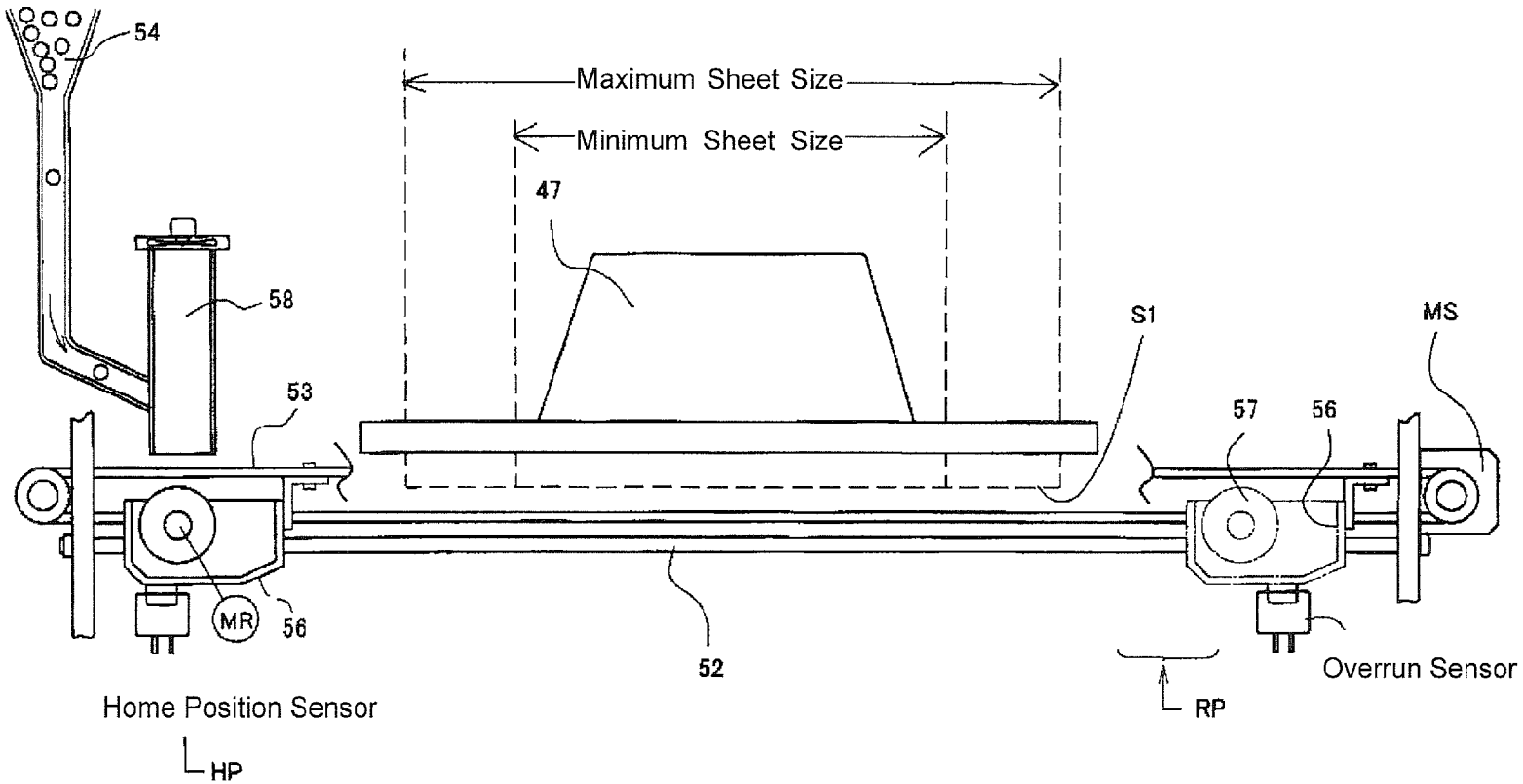
FIG. 3B is a different format to that shown in FIG. 3A with a layout of the adhesive applicator in the apparatus shown in FIG. 2.
Figure 4A:
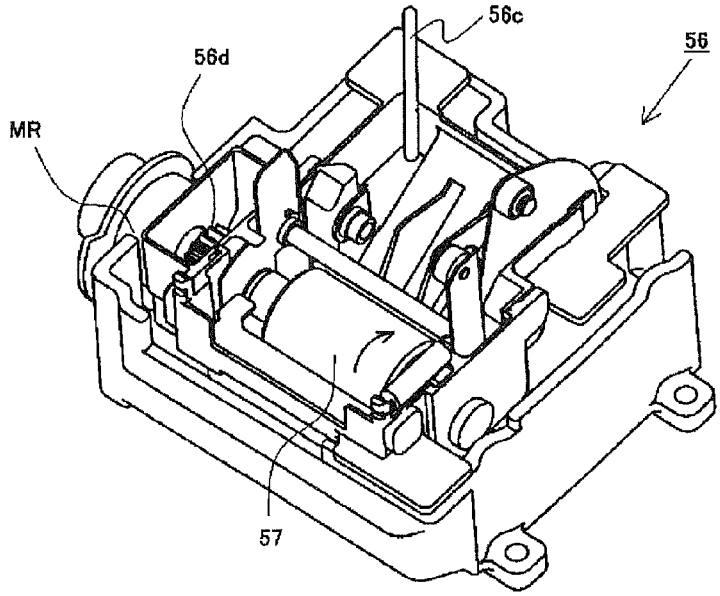
FIGS. 4A to 4C are explanatory views of the adhesive applicator in the apparatus shown in FIG. 2; 4A is a perspective view; 4B and 4C are sectional views.
Figure 4B:
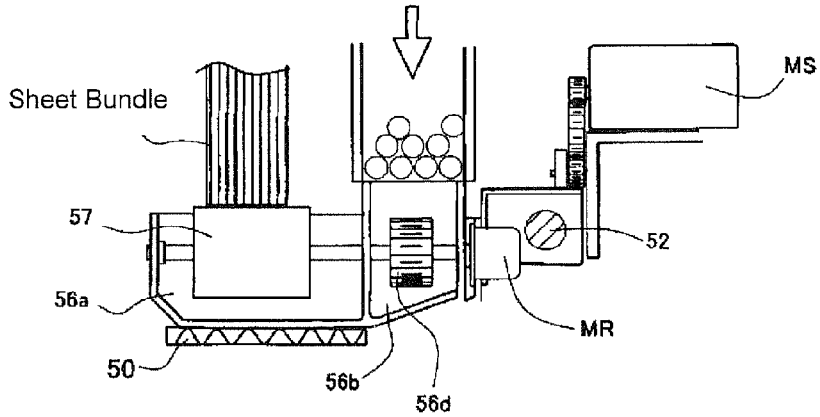
Figure 4C:
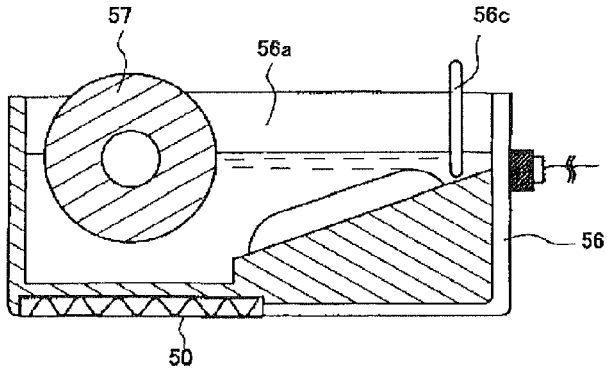

Rotation of the drive motor MS starts moving the glue container 56 from the left side of FIG. 3A to the right side along the guide rail 52 (from the left side to the right side in the state shown in FIG. 3B). The amount of travel of the gripping conveyance means 47 is adjusted by the elevator motor (not shown) so that the applicator roll 57 pressingly contacts the sheet bundle to slightly separate the edges of the sheets in the advancing path, and forms a predetermined gap with the sheet bundle edge in the return path to return from the return position RP to the home position HP to apply adhesive. The adjustment of the amount of adhesive using the amount of travel of the sheet bundle is based on the sheet bundle thickness information from the sheet bundle thickness detection means. If the sheet bundle is thick, the gap is widened to increase the amount of adhesive applied. If the thickness is small, the gap is narrowed to reduce the amount of adhesive applied. By controlling the elevator motor of the gripping conveyance means 47, the amount of travel of the sheet bundle can be adjusted. It is also acceptable to equip roll position adjusting means that adjust the position of the applicator roll 57 up or down. When the drive motor MS moves the glue container 50 from the operating position where adhesive is applied to the sheet bundle to the idle position EP separated therefrom at the idle instruction signal, adhesive can be refilled from an adhesive resupply-hopper means 54 arranged at the idle position EP.

With this configuration of the present invention, the glue container 56 is disposed to move along the sheet bundle to apply adhesive to the sheet bundle by reciprocating between the home position HP and the return position RP. The configuration allows the glue container 56 to move to an idle position EP retracted a distance from the return position RP. The adhesive resupply-hopper means 54 that refills the adhesive is disposed in this idle position EP. For example, this adhesive resupply-hopper means 54 is connected to a tank means (not shown) that stores solid adhesive for refilling. This adhesive resupply-hopper means 54 receives a predetermined amount of adhesive (a preset refilling amount) via a conveyor, not shown, from the tank means. The adhesive travels progressively from a trough-shaped resupply path 54*b* to a refill outlet 54*a*. The refill outlet 54*a* is positioned at the solid-matrix receiving compartment 56*b* of the glue container 56. Specifically, when the glue container 56 is positioned at the idle position EP, the refill outlet 54*a* of the adhesive resupply-hopper means 54 is configured to face the solid-matrix receiving compartment 56*b*.

A vacuum-ducting means 58 is disposed in a position adjacent to the resupply path 54*b*. The vacuum-ducting means 58 is composed of a duct 58*b* (vacuuming path) having a vacuum opening 58*a*; a vacuum fan 58*c*; and a fan motor Mf1. This suctions evaporation derivatives of the adhesive in the glue container 56. Note that a filter, not shown, is provided in vacuum fan 58*c* to filter the evaporation derivatives of the adhesive.

Figure 5A:
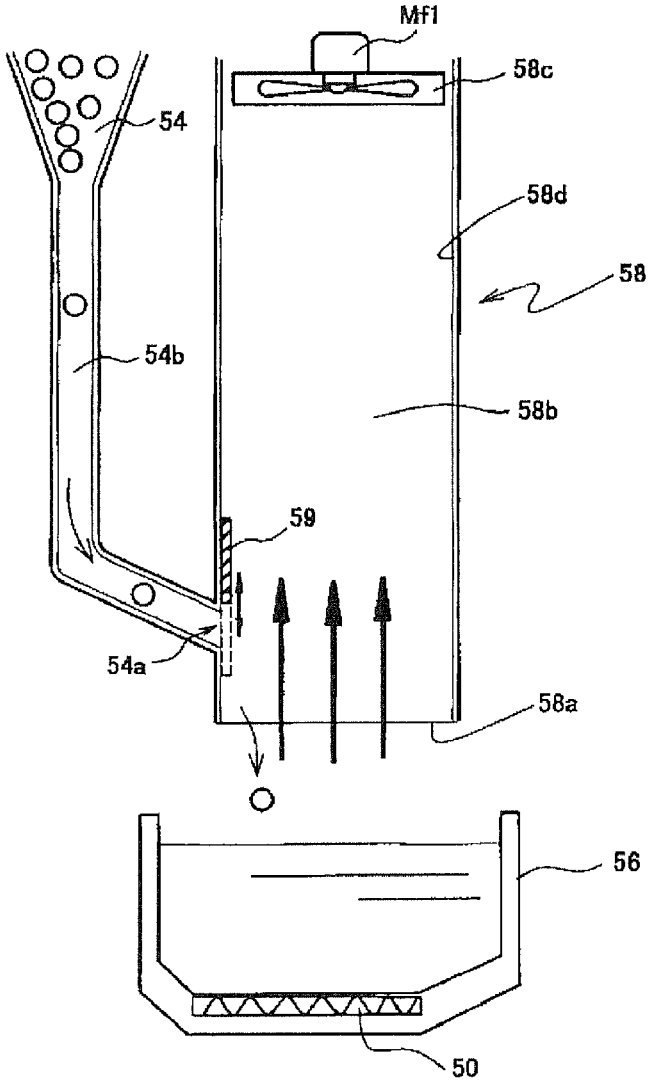
FIGS. 5A and 5B are explanatory views of the vacuum-ducting means in the apparatus shown in FIGS. 2; 5A is a vacuum duct configuration; 5B shows a shutter plate opening/closing mechanism.
Figure 5B:
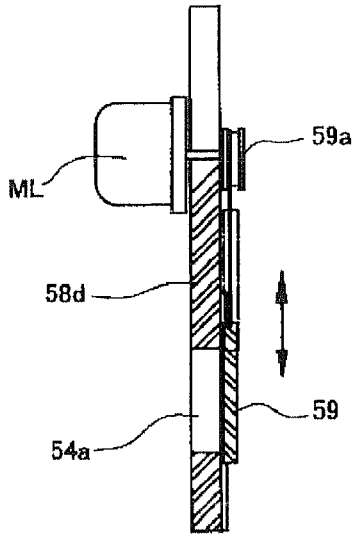

The vacuuming path (duct) 58*b* and solid adhesive filling path 54*b* have a shared opening to the glue container 56. A shutter plate 59 is disposed over the refill outlet 54*a* of the glue container 56. The shutter plate 59 is provided on the duct wall 58*d* to slide up and down to open and close the refill outlet 54*a*. The plate is urged downward in FIG. 5B by a spring, not shown, and suspended by a wire on a take-up pulley 59*a*. A take-up motor ML is connected to the take-up pulley 59*a*. Therefore, the shutter plate 59 opens the refill outlet 54*a* to allow solid adhesive to be supplied from the adhesive resupply-hopper means 54 to the solid-matrix receiving compartment 56*b* of the glue container 56.

The configuration of the control means for refilling adhesive will now be explained with reference to FIG. 6.

Figure 6:
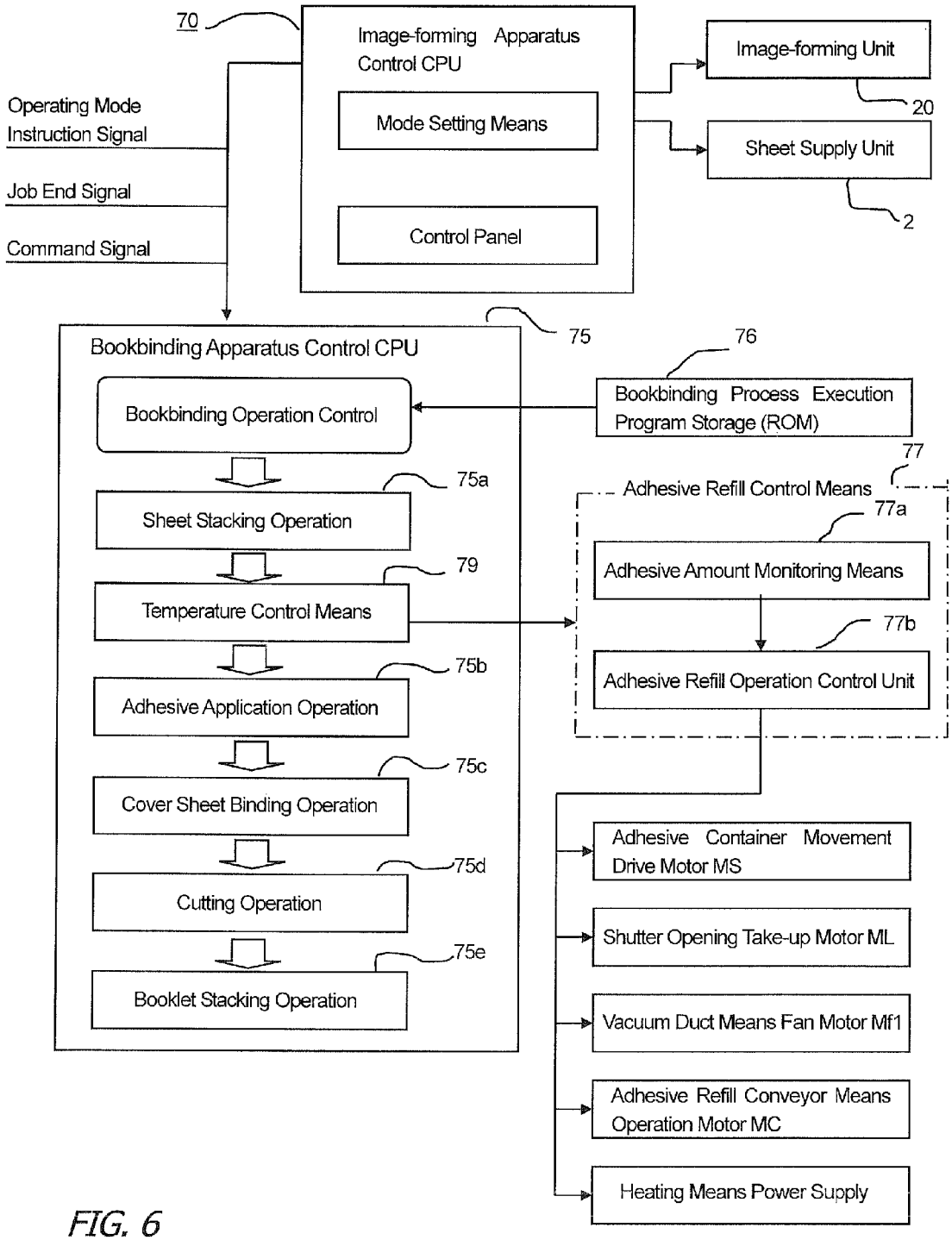
FIG. 6 is a block diagram of a configuration of a control unit in the apparatus shown in FIG. 2.

FIG. 6 is a block diagram. As shown in FIG. 1, in the system that connects the image-forming apparatus A and the bookmaking apparatus B, the control panel 71 and mode selection means 72 are provided on the control unit CPU provided on the image-forming apparatus A, for example. A control CPU 75 is provided in the control unit of the bookbinding apparatus B. This control CPU 75 calls up a bookbinding execution program from the ROM 76 and executes each process in the bookbinding path 33. This control CPU 75 receives a finishing mode instruction signal, job end signal and other information and command signals required in the bookbinding process from the control CPU 70 of the image-forming apparatus A.

The control CPU 75 is configured to read the bookbinding processing program from the ROM 76, and to execute each of the operations of the sheet stacking operation 75*a*, the adhesive temperature control operation (temperature control means) 79, the adhesive application operation 75*b*, the cover sheet binding operation 75*c*, the cutting operation 75*d*, and the booklet stacking operation 75*e*. The control CPU 75 is equipped with an adhesive refill control means 77 that monitors the remaining amount of adhesive in the glue container 56 during the bookbinding operation to refill the adhesive. The control means 77 is composed of an adhesive amount monitoring means 77*a* and an adhesive refill operation control unit 77*b*. The monitoring means 77*a* determines whether the adhesive in the container is above a predetermined amount using detection signals from the adhesive sensor 56*c* during the bookbinding process (steps St001 and St004 described below). This determination is performed by comparing the detection signal from the adhesive sensor 56*c* to a reference value.

The adhesive refill operation control unit 77*b* is connected to control the drives of a drive motor MS that reciprocates the glue container 56; a shutter plate take-up motor ML; a heating means 50; a fan motor Mf1 of the vacuum-ducting means 58; and an actuator motor MC of the conveyor means (not shown).

Figure 7:
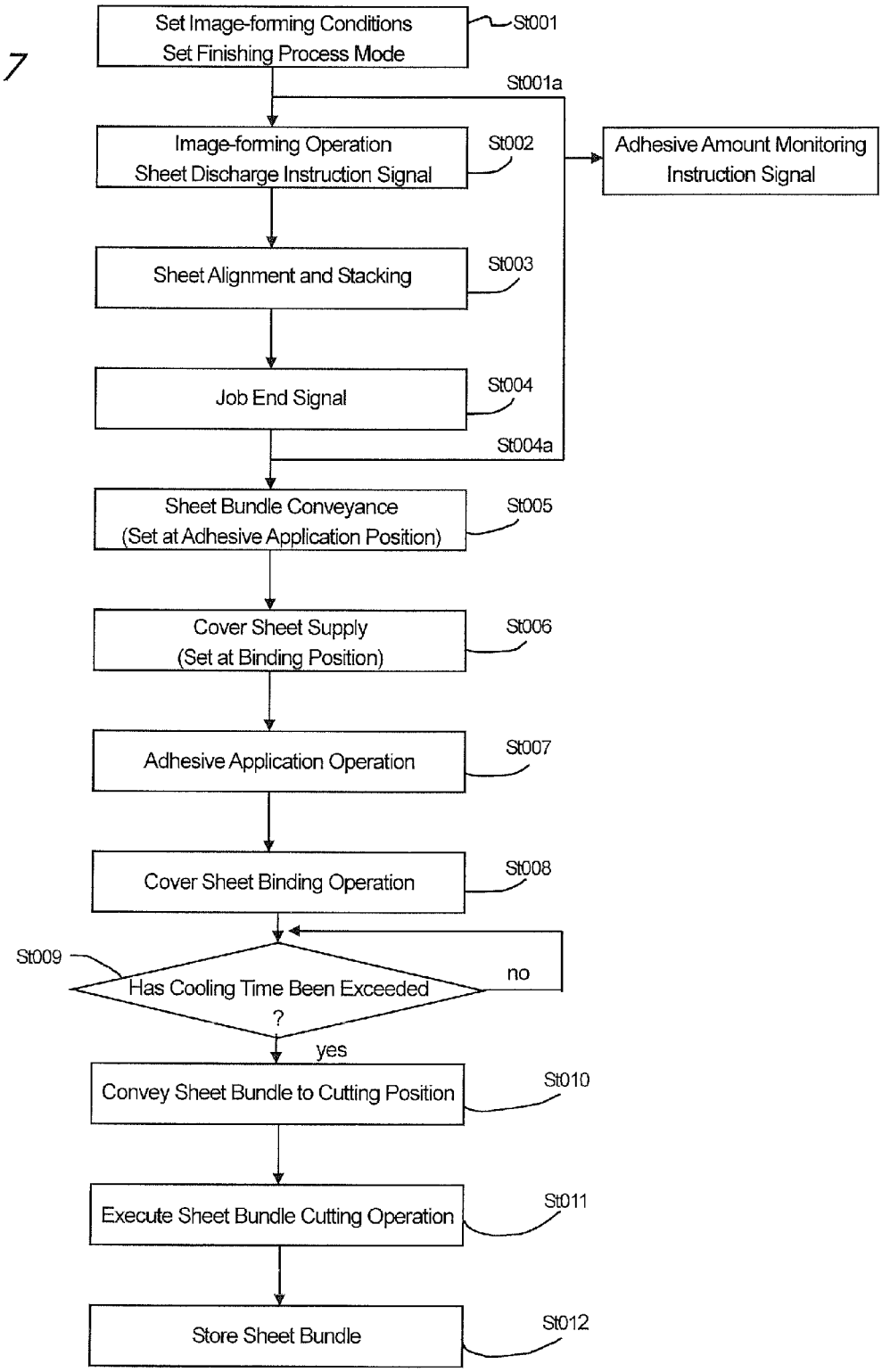
FIG. 7 is a flowchart showing operating procedures of a bookbinding process in the apparatus shown in FIG. 2.
Figure 8:
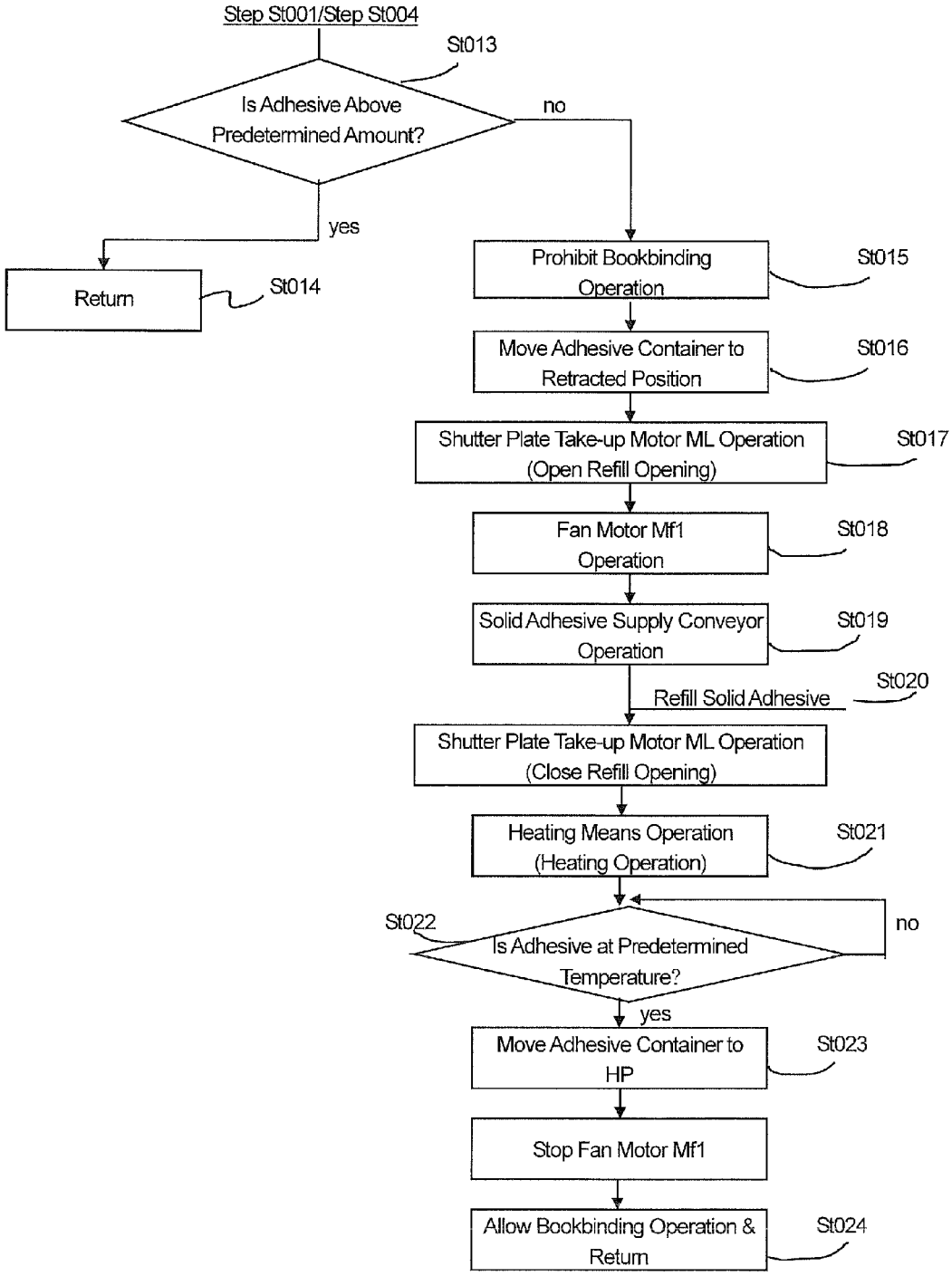
FIG. 8 is a flowchart showing adhesive amount monitoring operations of the flowchart shown in FIG. 7.

The bookbinding operations by the control CPU 75 and the adhesive refilling operation by the adhesive refill control means 77 will be explained with reference to the flowcharts of FIGS. 7 and 8.

Image forming conditions and a finishing mode are set (St001) using the control panel 71 on the image-forming apparatus A. "Print-out mode," "Bookbinding mode," "Staple mode," "Marking mode," "Hole-punching mode," and "Jog mode" can be set as the finishing mode, for example. In the print-out mode, a sheet formed with an image is not formed into a booklet or finished. It is conveyed out to the discharge tray 37 (provided on the finisher in the drawings) and stored.

With the bookbinding mode, sheets formed images are aligned and stacked, then joined with a cover sheet and stored in the storage stacker 67. Also, in the staple mode, sheets formed with images are stapled by a stapling unit provided in the finisher C; in the marking mode, a mark is applied; in the hole-punching mode, holes are punched in the sheets; and in the jog mode, sheets are sorted. Each of these modes is executed by the finisher, and then the finished sheets are stored in the discharge tray 37.

At step St001, if the bookbinding making mode has been selected, the control CPU 75 issues the adhesive amount monitoring instruction signal at St001*a* to determine the amount of adhesive and to execute the refill operation, both explained below. Next, an image forming operation is executed by the image-forming apparatus A, and the sheet formed with images is conveyed out from the discharge outlet 14 (St002) When a discharge instruction signal is received from the image-forming apparatus A, the control CPU 75 of the bookbinding apparatus B drives the conveyor motor of the inner-sheet conveyance path 32 (the sheet conveyance path) to convey in the sheet from the conveyance in inlet 31*a* and discharge it from the discharge outlet 32*b*. Sheets fed to the discharge outlet 32*b* are stacked in the stacking tray 41 and are aligned (St003) When the job end signal is received (St004) from the image-forming apparatus A, the control CPU 75 issues the adhesive amount monitoring instruction signal at St004*a* to determine the amount of adhesive and to execute the refill operation, both explained below.

The control CPU 75 conveys the sheet bundle stacked in the tray to the downstream bookbinding path 33 (St005) using the gripping conveyance means 47 at the same time as the adhesive amount monitoring instruction signal. To convey the sheet bundle, the stacking tray 41 is lowered from the stacking position to the conveying position, as shown in FIG. 1. At that position, the gripping conveyance means 47 grips the sheet bundle. Next, the gripping conveyance means 47 rotates the sheet bundle substantially 90° so that the sheet bundle changes from a horizontal orientation to a vertical orientation. After the sheet bundle orientation has been changed, the gripping conveyance means 47 conveys the sheet bundle so that its bottom edge is positioned at the adhesive application position E.

Next, while the time when the control CPU 75 conveys the sheet bundle to the adhesive application position E, it conveys a cover sheet from the cover sheet conveyance path 34 and sets it at the cover sheet binding position F (St006). Note that the cover sheet can be fed from the image-forming apparatus A or from the inserter device 26. The control CPU 75 then executes the adhesive application operation.

This operation moves the glue container 56 that is at the home position HP shown in FIG. 3A along the bottom edge of the sheet bundle and returns it to the return position RP. In that outgoing action, the applicator roll 57 pushes against the sheet bundle to separate the edges of the sheets and applies adhesive to sheet bundle in the returning action.

Next, the control CPU 75 conveys the sheet bundle applied with adhesive to the downstream cover sheet binding position F by operating the gripping conveyance means 47. The sheet bundle is joined to the cover sheet at the cover sheet binding position F in an upside-down T configuration. At this time, the cover sheet is supported by the back-support plate 61. In this state, the folding plates 62 sandwich the sheet bundle to press the cover sheet and fold it over the spine of the sheet bundle. With this series of actions, the cover sheet is bonded to the sheet bundle (St008).

Then, the control CPU 75 waits for a predetermined cooling time to pass (St009). After the predetermined cooling time has passed, the control CPU 75 retracts the back-support plate 61 and the folding plates 62 from the bookbinding path 33 and rotatingly drives the folding rollers 63 to convey the sheet bundle to the downstream cutting process position G (St010). Next, the control CPU 75 operates the cutting means 65 to trim the top, the base and thumb-edge portions of the sheet bundle for their alignment (St011). After this cutting operation on the sheet bundle is completed, the control CPU 75 stores the finished sheet bundle in the storage stacker 67 (St012).

When the adhesive amount monitoring instruction signal is issued at steps St001 and St004, the adhesive refill control means 77 provided on the control CPU 75 executes the following operations. To explain according to the flowchart shown in FIG. 8, when the instruction signal is received, the adhesive refill control means 77 determines whether the amount of adhesive is above a predetermined level (St013). If the determination is that the amount of adhesive is above a predetermined level, the glue container 56 is normal and the system returns to the previous step to execute the following operations (St014). If the determination is that the amount of adhesive is below a predetermined level, the adhesive refill control means 77 issues a signal prohibiting the bookbinding operation and prohibits the subsequent operations at the previous step (St015). Next, the adhesive refill control means 77 moves the glue container 56 from the return position RP to the idle position EP separated therefrom (St016). At the same time as moving to the idle position EP, the adhesive refill control means 77 runs the take-up motor ML to move the shutter plate 59 upward in FIG. 3A (FIG. 3B) to open the refill outlet 54*a* (St017).

While the refill outlet 54*a* is open, the adhesive refill control means 77 runs the fan motor Mf1 of the vacuum-ducting means 58. The fan suctions out the evaporated component of the adhesive in the glue container 56 from the vacuuming path (duct) 58*b* and collects it in a filter (St018). Next, the adhesive refill control means 77 moves the conveyor means, not shown, to move a predetermined amount of the solid adhesive from the adhesive storage tank to the adhesive resupply-hopper means 54 (St019). When that occurs, the solid adhesive fills the solid-matrix receiving compartment 56*b* of the glue container 56 from the filling path 54*b* (St020). After refilling the solid adhesive, the adhesive refill control means 77 runs the take-up motor ML to close the refill outlet 54*a* with the shutter plate 59.

Next, the adhesive refill control means 77 activates the heating means 50 of the glue container 56 to raise the temperature of the adhesive in the glue container 56 to melt the adhesive. Then, the system waits for some time for the adhesive in the glue container to reach a predetermined temperature and melt (St022). The evaporation derivatives generated by melting the adhesive is suctioned away and eliminated from the vacuum-ducting means 58. The adhesive refill control means 77 then moves the glue container 56 to its home position HP (St023). The adhesive refill control means 77 then sends the bookbinding operation ready signal. After this ready signal is sent, the system returns (St024) to the steps above to execute the bookbinding operation.

This application claims priority rights from Japanese Pat. App. No. 2006-239577, which is herein incorporated by reference.

What is claimed is:

1. An adhesive applicator comprising:

sheet retaining means for retaining a sheet sheaf in a predetermined glue application position;

adhesive application means, disposed in the glue application position, for applying adhesive to one endface of the sheet sheaf;

a glue container, having said adhesive application means, for receiving hot-melt adhesive, said glue container being disposed free to travel paralleling the glue-application endface of the sheet sheaf;

shift means for reciprocating the glue container along the glue-application endface of the sheet sheaf between a resupply position and a return position;

heating means, disposed in said glue container, for heating and melting the adhesive inside;

temperature control means for controlling said heating means;

resupply-hopper means for replenishing said glue container with adhesive in solid form;

a resupply path furnished in between said resupply-hopper means and said glue container, said resupply path being formed with an elbow for guiding the solid-form adhesive;

vacuum-ducting means for suctioning glue constituents evaporated from said container; and control means for controlling said resupply-hopper means and said vacuum-ducting means; wherein said resupply-hopper means and said vacuum-ducting means are disposed in said resupply position, in adjoining positions above said glue container; and said control means is configured to actuate said vacuum-ducting means when adhesive said glue container is being replenished with adhesive from said resupply-hopper means, to prevent or mitigate invasion of evaporation derivatives into said resupply-hopper means.

2. The adhesive applicator according to claim 1, wherein said resupply path is configured branching from an evaporation-derivative vacuuming path provided in said vacuum-ducting means.

3. The adhesive applicator according to claim 1, wherein said control means is configured to halt said heating means when said glue container is being replenished with adhesive from said resupply-hopper means.

4. The adhesive applicator according to claim 1, wherein:

a resupply path for guiding adhesive in solid form is formed between said resupply-hopper means and said glue container; and in the resupply path a shutter plate is furnished free to open/shut.

5. The adhesive applicator according to claim 1, wherein said control means is configured to actuate said heating means in the resupply position, after said glue container is replenished with adhesive from said resupply-hopper means, to melt the adhesive.

6. The adhesive applicator according to claim 1, wherein:

the glue container is sectioned into two receiving portions, a liquid-matrix receiving compartment and a solid-matrix receiving compartment;

the adhesive application means comprises an applicator roll, said applicator roll being disposed free to rotate in the liquid-matrix receiving compartment;

said vacuum-ducting means is disposed so that a suction inlet in its vacuuming path faces toward the liquid-matrix receiving compartment; and said resupply-hopper means is disposed so that its feed port faces the solid-matrix receiving compartment.

7. A bookbinding apparatus comprising:

a stacking tray means for stacking sequentially fed sheets into sheaves;

an adhesive applicator, furnished with the configuration recited in claim 1, for applying adhesive to sheet sheaves from said stacking tray means;

cover-sheet binding means for binding cover sheets onto sheet sheaves from said adhesive applicator; and a booklet stacker means for stowing sheet sheaves from said cover-sheet binding means.

8. An image-forming system comprising:

an image-forming apparatus for forming images onto sequential sheets; and a bookbinding apparatus, furnished with the configuration recited in claim 7, for stacking into sheaves sheets from said image-forming apparatus, and applying adhesive to the sheaves and binding them together with cover sheets.

9. An adhesive applicator comprising:

sheet retaining means for retaining a sheet sheaf in a predetermined glue application position;

adhesive application means, disposed in the glue application position, for applying adhesive to one endface of the sheet sheaf;

a glue container, having said adhesive application means, for receiving hot-melt adhesive, said glue container being disposed free to travel paralleling the glue-application endface of the sheet sheaf;

shift means for reciprocating the glue container along the glue-application endface of the sheet sheaf between a resupply position and a return position;

heating means, disposed in said glue container, for heating and melting the adhesive inside;

resupply-hopper means for replenishing said glue container with adhesive in solid form;

resupply path furnished in between said resupply-hopper means and said glue container, said resupply path being formed with an elbow for guiding the solid-form adhesive;

a resupply path, provided between said resupply-hopper means and said glue container, for guiding adhesive in solid form; and ducting means for clearing away glue constituents evaporated from said container; wherein said resupply-hopper means and said ducting means are disposed in said resupply position, in adjoining positions above said glue container; and in the resupply path a shutter plate is furnished free to open/shut.

10. The adhesive applicator according to claim 9, configured so that said shutter plate opens the resupply path when said glue container is being replenished with adhesive from said resupply-hopper means.

11. The adhesive applicator according to claim 9, further comprising a control means for actuating said heating means in the resupply position, after said glue container is replenished with adhesive from said resupply-hopper means, to melt the adhesive.

12. The adhesive applicator according to claim 9, wherein:

the glue container is sectioned into two receiving portions, a liquid-matrix receiving compartment and a solid-matrix receiving compartment;

the adhesive application means comprises an applicator roll, said applicator roll being disposed free to rotate in the liquid-matrix receiving compartment;

said ducting means is disposed so as to face toward the liquid-matrix receiving compartment; and said resupply-hopper means is disposed so as to face the solid-matrix receiving compartment.

13. A bookbinding apparatus comprising:

a stacking tray means for stacking sequentially fed sheets into sheaves;

an adhesive applicator, furnished with the configuration recited in claim 9, for applying adhesive to sheet sheaves from said stacking tray means;

cover-sheet binding means for binding cover sheets onto sheet sheaves from said adhesive applicator; and a booklet stacker means for stowing sheet sheaves from said cover-sheet binding means.

14. An image-forming system comprising:

an image-forming apparatus for forming images onto sequential sheets; and a bookbinding apparatus, furnished with the configuration recited in claim 13, for stacking into sheaves sheets from said image-forming apparatus, and applying adhesive to the sheaves and binding them together with cover sheets.

15. An adhesive applicator comprising:

sheet retaining means for retaining a sheet sheaf in a predetermined glue application position;

adhesive application means, disposed in the glue application position, for applying adhesive to one endface of the sheet sheaf;

a glue container, having said adhesive application means, for receiving hot-melt adhesive, said glue container being disposed free to travel paralleling the glue-application endface of the sheet sheaf;

shift means for reciprocating the glue container along the glue-application endface of the sheet sheaf between a resupply position and a return position;

heating means, disposed in said glue container, for heating and melting the adhesive inside;

resupply-hopper means for replenishing said glue container with adhesive in solid form;

a resupply path, provided between said resupply-hopper means and said glue container, for guiding adhesive in solid form; and ducting means for clearing away glue constituents evaporated from said container; wherein said resupply-hopper means and said ducting means are disposed in said resupply position, in adjoining positions above said glue container.

* * * * *